US010469971B2

(12) United States Patent
Zhang et al.

(10) Patent No.: US 10,469,971 B2
(45) Date of Patent: Nov. 5, 2019

(54) AUGMENTED PERFORMANCE SYNCHRONIZATION

(71) Applicant: Apple Inc., Cupertino, CA (US)

(72) Inventors: Zhipeng Zhang, Santa Clara, CA (US); Brian T. Gleeson, Mountain View, CA (US); Michael Diu, Campbell, CA (US); Addison Cugini, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/708,715

(22) Filed: Sep. 19, 2017

(65) Prior Publication Data

US 2018/0084362 A1 Mar. 22, 2018

Related U.S. Application Data

(60) Provisional application No. 62/396,451, filed on Sep. 19, 2016.

(51) Int. Cl.

| | |
|---|---|
| ***H04S 7/00*** | (2006.01) |
| ***G08B 6/00*** | (2006.01) |
| ***H04R 3/00*** | (2006.01) |
| *H04R 1/10* | (2006.01) |

(52) U.S. Cl.

CPC ..... *H04S 7/00* (2013.01); *G08B 6/00* (2013.01); *H04R 3/00* (2013.01); *H04R 1/1008* (2013.01); *H04R 2400/00* (2013.01); *H04R 2410/00* (2013.01); *H04R 2460/13* (2013.01); *H04R 2499/11* (2013.01); *H04S 2400/03* (2013.01)

(58) Field of Classification Search

CPC ..... H04S 7/00; H04S 2400/03; G08B 6/00; G06F 3/016

USPC ..... 700/94; 345/156; 381/326, 58; 702/109, 85

See application file for complete search history.

(56) References Cited

U.S. PATENT DOCUMENTS

| | | |
|---|---|---|
| 8,125,442 B2 | 2/2012 | Chu |
| 9,083,821 B2 | 7/2015 | Hughes |
| 9,274,603 B2 | 3/2016 | Moddares et al. |
| 9,607,527 B2 | 3/2017 | Hughes |

(Continued)

OTHER PUBLICATIONS

Groβhauser, Tobias et al. "Wearable Multi-Modal Sensor System for Embedded Audio-Haptic Feedback", Proceedings of ISon 2010, 3rd Interactive Sonification Workshop, KTH, Stockholm, Sweden, Apr. 7, 2010, pp. 75-79.

(Continued)

*Primary Examiner* — Melur Ramakrishnaiah

(74) *Attorney, Agent, or Firm* — Kilpatrick Townsend & Stockton LLP

(57) ABSTRACT

Various embodiments of the invention pertain to augmented performance synchronization systems and methods. According to some embodiments of the invention, an audio waveform may be used to generate one or more haptic waveforms for one or more electronic devices. The haptic waveforms may be generated based on any of a number of factors, including features of the audio waveform, capabilities of the haptic actuators performing the haptic waveforms, the number, type and location of devices having haptic actuators, and the like. The haptic waveforms may be synchronized with performance of the audio waveform to provide an augmented listening experience to a user.

16 Claims, 8 Drawing Sheets

(56) References Cited

U.S. PATENT DOCUMENTS

| | | | | |
|---|---|---|---|---|
| 2013/0265286 | A1* | 10/2013 | Da Costa | G08B 6/00 345/177 |
| 2014/0056461 | A1* | 2/2014 | Afshar | H04R 1/00 381/385 |
| 2014/0176415 | A1* | 6/2014 | Buuck | G06F 3/016 345/156 |
| 2015/0077234 | A1 | 3/2015 | Fullum | |
| 2015/0325116 | A1* | 11/2015 | Umminger | G08C 17/00 367/197 |
| 2016/0063828 | A1* | 3/2016 | Moussette | G08B 6/00 340/540 |
| 2016/0163165 | A1* | 6/2016 | Morrell | G08B 6/00 340/407.1 |

OTHER PUBLICATIONS

Hughes, Gregory F., Unpublished U.S. Appl. No. 15/469,368, "Converting Audio to Haptic Feedback in an Electronic Device", filed Mar. 24, 2017, 35 pages.

* cited by examiner

AUGMENTED PERFORMANCE SYNCHRONIZATION

CROSS REFERENCES TO RELATED APPLICATIONS

This application claims priority to U.S. Provisional Patent Application No. 62/396,451, filed Sep. 19, 2016, the disclosure of which is hereby incorporated by reference in its entirety.

FIELD

The present disclosure relates generally to augmenting the performance of waveforms with haptic elements.

BACKGROUND

Electronic devices are prevalent in today's society and are becoming more prevalent as time goes on. Users may have multiple electronic devices at any given time, including cell phones, tablet computers, MP3 players, and the like. Users may also employ wearable electronic devices, such as watches, headphones, ear buds, fitness bands, tracking bracelets, armbands, belts, rings, earrings, glasses, helmets, gloves, and the like. In some instances, these wearable electronic devices are slave devices to other electronic devices, such as cell phones. For example, a set of headphones may rely on receiving an audio waveform from a cell phone in order to play music.

Some electronic devices include an ability to process and output waveforms of different types. For example, many electronic devices may be able to output audio waveforms and haptic waveforms. In some instances, haptic waveforms may be used to augment audio waveforms, such as to cause a cell phone to vibrate when it is ringing. These haptic waveforms are usually discretely defined waveforms having a set frequency, amplitude, and length.

SUMMARY

Various embodiments of the invention pertain to augmented performance synchronization systems and methods that improve upon some or all of the above described deficiencies. According to some embodiments of the invention, an audio waveform may be used to generate a haptic waveform for an electronic device. The haptic waveforms may be generated based on any of a number of factors, including features of the audio waveform, capabilities of the haptic actuators performing the haptic waveforms, the number, type and location of haptic actuators and/or devices having haptic actuators, and the like. The haptic waveforms may be synchronized with performance of the audio waveform to provide an augmented listening experience to a user. According to some embodiments of the invention, an audio waveform may be used to generate a plurality of haptic waveforms for a plurality of haptic actuators in one or more devices.

In some embodiments, a method is provided. The method comprises receiving, by an electronic device including a speaker and a haptic actuator, an audio waveform. The audio waveform may be stereophonic. The method further comprises attenuating the audio waveform. The method further comprises converting the attenuated audio waveform from stereophonic to monophonic. The method further comprises processing the monophonic audio waveform to generate an actuator control signal. The method further comprises amplifying the actuator control signal. The method further comprises generating an audio output using the audio waveform at the one or more speakers. The method further comprises synchronizing transmission of the actuator control signal to the haptic actuator with transmission of the audio output to the one or more speakers. The method further comprises actuating the haptic actuator with the actuator control signal while performing the audio output by the one or more speakers.

In some embodiments, a method is provided. The method comprises detecting, by a host device, a slave device in communication with the host device. The host device includes a host actuator. The slave device includes a slave actuator. The method further comprises determining, by the host device, capabilities of the host actuator and capabilities of the slave actuator. The host device determines the capabilities of the slave actuator through communication with the slave device. The method further comprises retrieving, by the host device, a waveform. The method further comprises processing, by the host device, the waveform to generate a host waveform and a slave waveform. The waveform is processed to generate the host waveform according to the capabilities of the host actuator. The waveform is processed to generate the slave waveform according to the capabilities of the slave actuator. The method further comprises transmitting, by the host device, the slave waveform to the slave device. When the slave waveform is received at the slave device, the slave device processes the slave waveform. The method further comprises facilitating, by the host device, transmission of the waveform. The method further comprises facilitating, by the host device, synchronized processing of the waveform, the host waveform, and the slave waveform through communication with the slave device.

In some embodiments, a host device is provided. The host device comprises a host actuator, one or more processors, and a non-transitory computer-readable medium containing instructions that, when executed by the one or more processors, cause the one or more processors to perform operations including the steps of the above method, for example.

In some embodiments, a computer-program product is provided. The computer-program product is tangibly embodied in a non-transitory machine-readable storage medium of a host device, including instructions that, when executed by one or more processors, cause the one or more processors to perform operations including the steps of the above method, for example.

The following detailed description together with the accompanying drawings in which the same reference numerals are sometimes used in multiple figures to designate similar or identical structural elements, provide a better understanding of the nature and advantages of the present disclosure.

DETAILED DESCRIPTION

Figure 1:
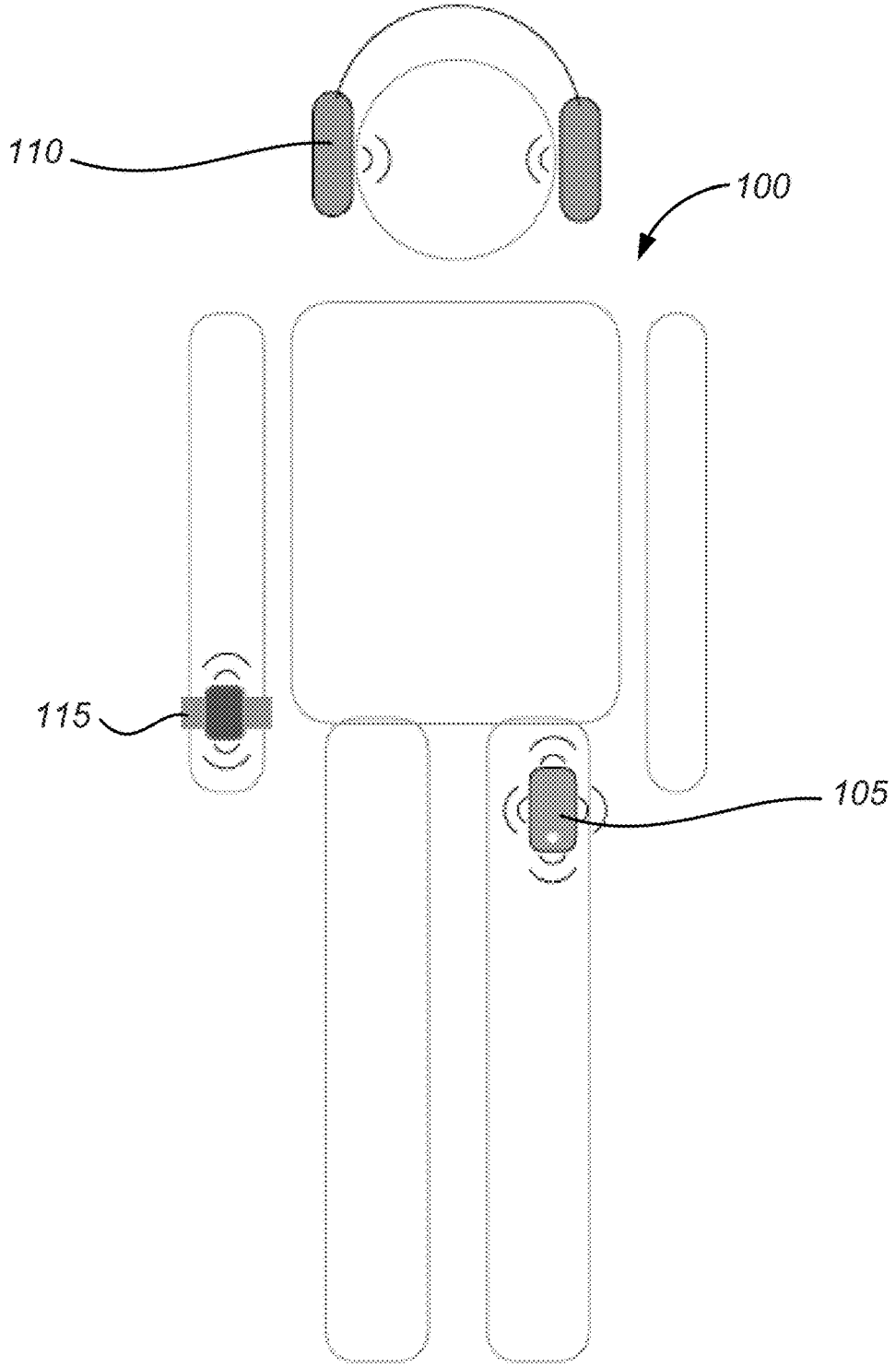
FIG. 1 shows a front view of a user having multiple electronic devices in accordance with some embodiments of the disclosure.

Certain aspects and embodiments of this disclosure are provided below. Some of these aspects and embodiments may be applied independently and some of them may be applied in combination as would be apparent to those of skill in the art. In the following description, for the purposes of explanation, specific details are set forth in order to provide a thorough understanding of embodiments of the invention. However, it will be apparent that various embodiments may be practiced without these specific details. The figures and description are not intended to be restrictive.

The ensuing description provides exemplary embodiments only, and is not intended to limit the scope, applicability, or configuration of the disclosure. Rather, the ensuing description of the exemplary embodiments will provide those skilled in the art with an enabling description for implementing an exemplary embodiment. It should be understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, circuits, systems, networks, processes, and other components may be shown as components in block diagram form in order not to obscure the embodiments in unnecessary detail. In other instances, well-known circuits, processes, algorithms, structures, and techniques may be shown without unnecessary detail in order to avoid obscuring the embodiments.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in a figure. A process may correspond to a method, a function, a procedure, a subroutine, a subprogram, etc. When a process corresponds to a function, its termination can correspond to a return of the function to the calling function or the main function.

The term "computer-readable medium" includes, but is not limited to, portable or non-portable storage devices, optical storage devices, and various other mediums capable of storing, containing, or carrying instruction(s) and/or data. A computer-readable medium may include a non-transitory medium in which data can be stored and that does not include carrier waves and/or transitory electronic signals propagating wirelessly or over wired connections. Examples of a non-transitory medium may include, but are not limited to, a magnetic disk or tape, optical storage media such as compact disk (CD) or digital versatile disk (DVD), flash memory, memory or memory devices. A computer-readable medium may have stored thereon code and/or machine-executable instructions that may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, or the like.

Furthermore, embodiments may be implemented by hardware, software, firmware, middleware, microcode, hardware description languages, or any combination thereof. When implemented in software, firmware, middleware or microcode, the program code or code segments to perform the necessary tasks (e.g., a computer-program product) may be stored in a computer-readable or machine-readable medium. A processor(s) may perform the necessary tasks.

Reference is now made to FIG. 1, which depicts a front view of a user 100 having multiple electronic devices according to some embodiments of the present invention. As shown, user 100 has three electronic devices: headphones 110, watch 115, and mobile device 105. In some embodiments, one or more of headphones 110, watch 115, and mobile device 105 may include one or more haptic actuators adapted to provide tactile feedback to user 100. Headphones 110, watch 115, and/or mobile device 105 may also include speakers adapted to perform audio waveforms. Although shown and described herein with respect to "headphones", e.g., headphones 110, it is contemplated that the embodiments described herein may similarly apply to any head mounted, in ear, on ear, and/or near ear listening device, such as wired or wireless earbuds and the like.

An "electronic device" as used herein may refer to any suitable device that includes an electronic chip or circuit and that may be operated by a user. In some embodiments, the electronic device may include a memory and processor. In some embodiments, the electronic device may be a communication device capable of local communication to one or more other electronic devices and/or remote communication to a network. Examples of local communication capabilities include capabilities to use Bluetooth, Bluetooth LE, near field communication (NFC), wired connections, and the like. Examples of remote communication capabilities include capabilities to use a cellular mobile phone or data network (e.g., 3G, 4G, or similar networks, WiFi, WiMax, or any other communication medium that may provide access to a network, such as the Internet or a private network. Exemplary electronic devices include mobile devices (e.g., cellular phones), PDAs, tablet computers, netbooks, laptop computers, personal music players, headphones, handheld specialized readers, and wearable devices (e.g., watches, fitness bands, bracelets, necklaces, lanyards, ankle bracelets, rings, earrings, etc.). An electronic device may comprise any suitable hardware and software for performing such functions, and may also include multiple devices or components (e.g., when a device has remote access to a network by tethering to another device, i.e., using the other device as a modem, both devices taken together may be considered a single electronic device).

Augmented Performance by an Individual Device

Figure 2:
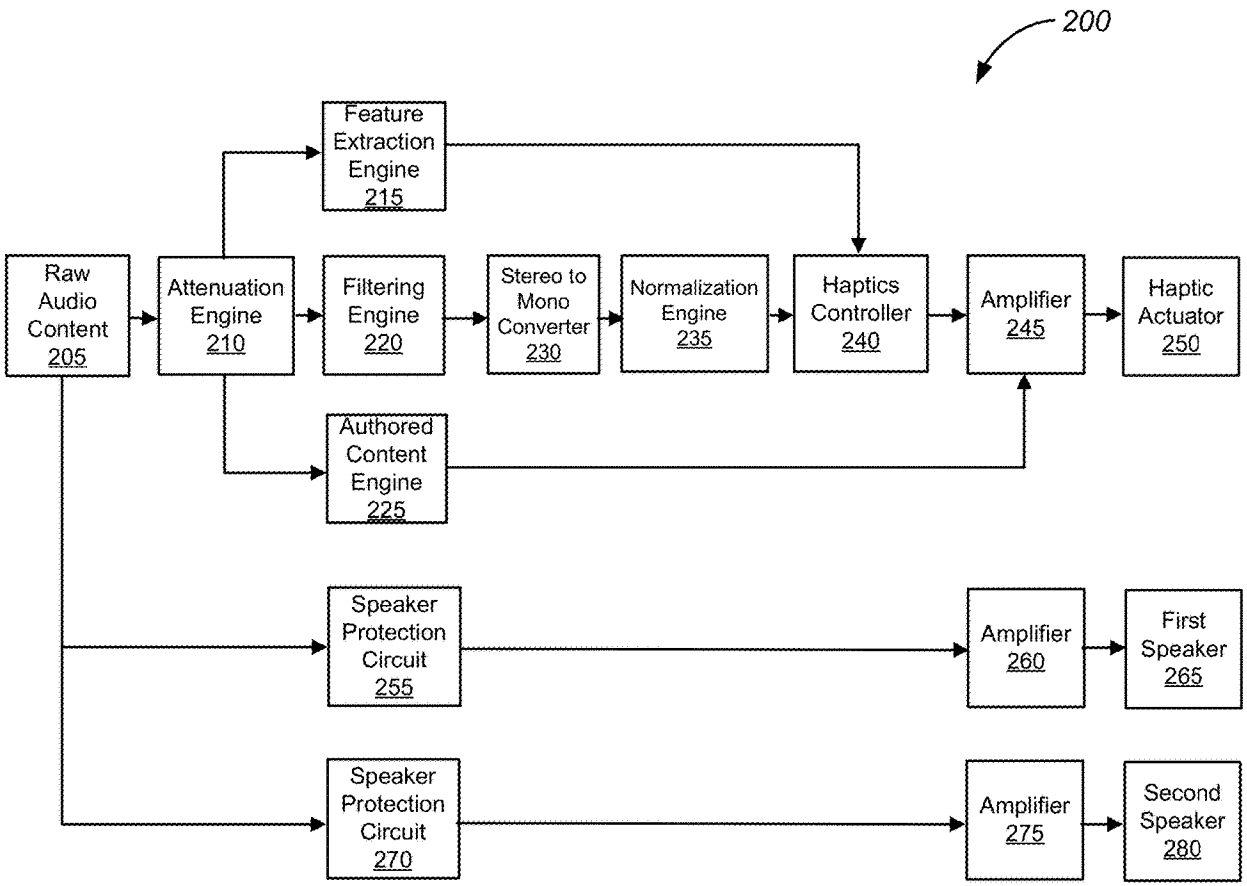
FIG. 2 shows a block diagram of an audio and haptics processing system in accordance with some embodiments of the disclosure.

FIG. 2 shows a block diagram of an audio and haptics processing system 200 included in an electronic device in accordance with some embodiments of the disclosure. Raw audio content 205 is input into the system 200. In some embodiments, the raw audio content 205 may be stereophonic. The raw audio content 205 may be retrieved and/or received from any suitable source, such as, for example, volatile or nonvolatile memory associated with the electronic device. The memory may be internal to the electronic device (e.g., an integrated memory chip) or external to the electronic device (e.g., a flash drive or cloud storage device). The external memory may be in wired and/or wireless communication with the electronic device over a network (e.g., a cellular network), WiFi, local communications (e.g., Bluetooth, near field communication, etc.), or any other suitable communication protocol. In some embodiments, the raw audio content 205 may be retrieved and/or received from a remote source and streamed to the electronic device, such as from a remote device (e.g., a server such as a media or content server, an application provider, another electronic device, etc.).

The raw audio content 205 may be passed to an attenuation engine 210. The attenuation engine 210 may be configured to attenuate the raw audio content 205 and output an attenuated signal. For example, the attenuation engine 210 may be configured to diminish or increase the signal strength of the raw audio content 205 in order to make the raw audio content 205 more suitable for haptics processing, as described further herein.

The attenuated signal may be input to one or more of the feature extraction engine 215, the filtering engine 220, and/or the authored content engine 225. As described further herein with respect to FIG. 3, the filtering engine 220 may be configured to pass the attenuated signal through a band-pass filter. In some embodiments in which the raw audio content 205 is stereophonic, the filtered signal may be converted from stereophonic to monophonic by the stereo to mono converter 230. The monophonic signal may be input to a normalization engine 235. The normalization engine 235 may be configured to modify (i.e., increase and/or decrease) the amplitude and/or frequency of the monophonic signal. In some embodiments, the modification may be uniform across the entire monophonic signal, such that the signal-to-noise ratio of the signal remains unchanged.

The normalized signal may be input into a haptics controller 240, which may generate a haptic waveform (e.g., an actuator control signal) based on the normalized signal in some embodiments. The haptic waveform may be input to an amplifier 245, which may increase the amplitude of the haptic waveform, and pass the amplified haptic waveform to a haptic actuator 250. The haptic actuator 250 may be configured to generate haptics (e.g., tactile sensations, such as vibrations) based on the amplified haptic waveform.

Alternatively or additionally, the attenuated signal may be passed through a feature extraction engine 215. The feature extraction engine 215 may be configured to run an algorithm on the attenuated signal to identify one or more predefined features of the attenuated signal and/or may map those one or more predefined features to predefined haptic elements. For example, the feature extraction engine 215 may run an algorithm identifying the beat of the attenuated signal. The feature extraction engine 215 may then pass the identified feature(s) (e.g., the beat) to the haptics controller 240. The haptics controller 240 may be configured to generate a haptic waveform (e.g., an actuator control signal) based on the identified feature(s) in some embodiments. The haptic waveform may be input to an amplifier 245, which may increase the amplitude of the haptic waveform, and pass the amplified haptic waveform to a haptic actuator 250. The haptic actuator 250 may be configured to generate haptics (e.g., tactile sensations, such as vibrations) based on the amplified haptic waveform.

Alternatively or additionally, the attenuated signal may be passed through an authored content engine 225. The authored content engine 225 may be configured to analyze the attenuated signal to determine whether a manually created haptic waveform corresponding to the raw audio content 205 exists. For example, the authored content engine 225 may use metadata from the raw audio content 205, audio features from the raw audio content 205, etc., to identify the raw audio content 205. Once identified, the authored content engine 225 may query a database (either local or remote) for a manually created haptic waveform corresponding to the raw audio content 205. If the manually created haptic waveform exists, the authored content engine 225 may retrieve and/or receive the haptic waveform. In some embodiments, the authored content engine 225 may also allow a user to manually create a haptic waveform, either to save for future use or to apply to the raw audio content 205. The haptic waveform may be input to an amplifier 245, which may increase the amplitude of the haptic waveform, and pass the amplified haptic waveform to a haptic actuator 250. The haptic actuator 250 may be configured to generate haptics (e.g., tactile sensations, such as vibrations) based on the amplified haptic waveform.

In some embodiments, the haptics controller 240 may be omitted, and a haptic waveform may not be generated. Instead, an audio signal may be input directly to the amplifier 245 and output to the haptic actuator 250. In these embodiments, the haptic actuator 250 may generate haptics directly from the frequencies of the audio signal, without the need for a haptic waveform.

Further processing of the raw audio content 205 may also be performed in order to perform the audio signal. In some embodiments in which the raw audio content 205 is stereophonic, the raw audio content 205 may be split into a first audio signal (e.g., corresponding to a left signal) and a second audio signal (e.g., corresponding to a right signal). The first audio signal may be passed through a speaker protection circuit 255. The speaker protection circuit 255 may protect the amplifier 260 and the first speaker 265 from unintentional outputs of DC voltage and/or unsafe levels of amplifier gain. The first audio signal may be input to an amplifier 260, which may increase the amplitude of the first audio signal. The first audio signal may be output through the first speaker 265 as an audio waveform.

Similarly, the second audio signal may be passed through a speaker protection circuit 270. The speaker protection circuit 270 may protect the amplifier 275 and the second speaker 280 from unintentional outputs of DC voltage and/or unsafe levels of amplifier gain. The first audio signal may be input to an amplifier 275, which may increase the amplitude of the first audio signal. The first audio signal may be output through the first speaker 280 as an audio waveform.

In embodiments in which the raw audio content 205 is monophonic, a single audio signal may be passed through speaker protection and an amplifier. The amplified signal may then be split between the first speaker 265 and the second speaker 280. In these embodiments, the first speaker 265 and the second speaker 280 may perform identical audio waveforms.

The performance of the haptic waveform by the haptic actuator 250 may be synchronized with the performance of the first audio waveform by the first speaker 265 and the second audio waveform by the second speaker 280, such that the waveforms align in timing. Although shown and described as generating a single haptic waveform based on the raw audio content 205, it is contemplated that multiple haptic waveforms for multiple haptic actuators in the electronic device may be generated. For example, a stereophonic raw audio content 205 may be split into its first and second audio signals and processed separately to generate two haptic waveforms to be performed by two separate haptic actuators. Further, although shown and described with respect to a certain number of components performing a certain number of functions, it is contemplated that any of the described and shown components may be omitted, additional components may be added, functions described with respect to particular components may be combined and performed by a single component, and/or functions described with respect to one component may be separated and performed by multiple components.

Figure 3:
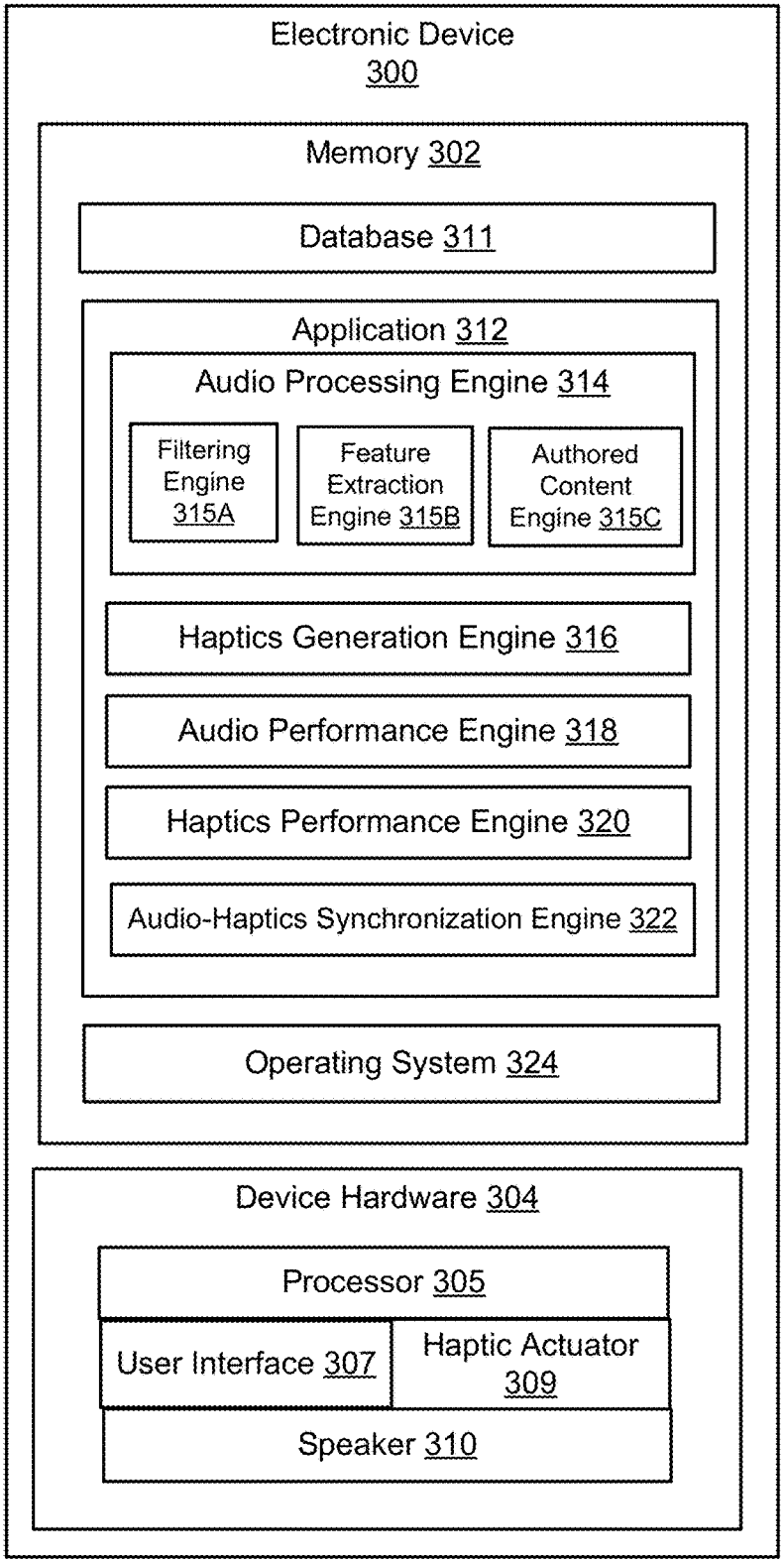
FIG. 3 shows a block diagram of an electronic device in accordance with some embodiments of the disclosure.

FIG. 3 shows a block diagram of an electronic device 300 in accordance with some embodiments of the disclosure. Electronic device 300 may be any of the electronic devices described herein. Although shown and described as having a certain number and type of components, it is contemplated that any combination of these components may exist in electronic device 300, and not all are required. In addition, additional components not shown may be included in electronic device 300, such as any of the components illustrated with respect to system 200 of FIG. 2, any of the components illustrated with respect to host device 505 of FIG. 6, and/or any of the components illustrated with respect to slave device 510 of FIG. 7.

Electronic device 300 may include device hardware 304 coupled to a memory 302. Device hardware 304 may include a processor 305, a user interface 307, a haptic actuator 309, and one or more speakers 310. Processor 305 may be implemented as one or more integrated circuits (e.g., one or more single core or multicore microprocessors and/or microcontrollers), and is used to control the operation of electronic device 300. Processor 305 may execute a variety of programs in response to program code or computer-readable code stored in memory 302, and can maintain multiple concurrently executing programs or processes.

User interface 307 may include any combination of input and/or output elements to allow a user to interact with and invoke the functionalities of the electronic device 300. In some embodiments, user interface 307 may include a component such as a display that can be used for both input and output functions. User interface 307 may be used, for example, to turn on and tuff off the audio augmentation functions of application 312, such as by using a toggle switch or other input element. In some embodiments, user interface 307 may be used to modify or adjust a haptic performance by the haptic actuator 309. For example, user interface 307 may include a button or other input element to increase or decrease the intensity of the haptics from the haptic actuator 309. In some embodiments, the increasing and/or decreasing of the intensity of the haptics may be synchronized with the increasing and/or decreasing of the volume of the audio waveform output by the speaker 310. In some embodiments, the input element may only be used to control the intensity of the haptics while haptics are being performed by the haptic actuator 309. When haptics are not being performed by the haptic actuator 309, the input element may correspond to one or more other functions. For example, the input element may control the volume of the audio waveform only, the volume of a ringer, etc.

Haptic actuator 309 may be any component capable of creating forces, pressures, vibrations and/or motions sensible by a user. For example, haptic actuator 309 may be an eccentric rotating mass (ERM) motor or a linear resonant actuator (LRA). Haptic actuator 309 may comprise electromagnetic, piezoelectric, magnetostrictive, memory alloy, and/or electroactive polymer actuators. Haptic actuator 309 may have any of a number of capabilities, such as a drive (DC or AC), drive voltage, a frequency (e.g., a resonant frequency in the case of an LRA), an amplitude, a power consumption, a response time, a vibration strength, a bandwidth and the like. Haptic actuator 309 may be a single frequency actuator or a wide band actuator. A single frequency actuator may have varied momentum, strength, and/or intensity, whereas a wide band actuator may vary in frequency. Although shown and described as having only one haptic actuator 309, it is contemplated that electronic device 300 may include any number of haptic actuators at any locations within electronic device 300. Haptic actuator 309 may, in some embodiments, be similar to haptic actuator 250 of FIG. 2.

Speaker 310 may be any of one or more components capable of outputting audio. Speaker 310 may, in some embodiments, be similar to or include first speaker 265 and/or second speaker 280 of FIG. 2. In some embodiments, speaker 310 may be omitted. In such embodiments, vibrations caused by haptic actuator 309 may be synchronized with performance of an audio waveform by an external device (e.g., external speakers) by the synchronization engine 322. In some embodiments, the external device may not have capability to perform a haptic waveform.

Memory 302 may be implemented using any combination of any number of non-volatile memories (e.g., flash memory) and volatile memories (e.g., DRAM, SRAM, etc.), or any other non-transitory storage medium, or a combination thereof. Memory 302 may store an operating system 324, a database 311, and an application 312 to be executed by processor 305.

Application 312 may include an application that receives, processes, generates, outputs, and/or synchronizes waveforms. In some embodiments, application 312 may include some or all of system 200 of FIG. 2. Application 312 may include an audio processing engine 314, a haptics generation engine 316, an audio performance engine 318, a haptics performance engine 320, and an audio-haptics synchronization engine 322.

The audio processing engine 314 may be adapted to retrieve and/or receive and process an audio waveform, e.g., raw audio content 205 of FIG. 2. In some embodiments, the audio waveform may be retrieved from database 311 of electronic device 300 (i.e., the audio waveform is already stored in electronic device 300). In some embodiments, the audio waveform may be retrieved from another device. For example, the electronic device 300 may retrieve an audio waveform that is stored locally on an external MP3 player. In some embodiments, the audio waveform may be retrieved from a remote server (e.g., a music streaming server). In some embodiments, the audio waveform may be retrieved in real-time from a component of device hardware 304 (e.g., a microphone).

Audio processing engine 314 may further process and analyze the audio waveform in some embodiments. This processing may be performed by a filtering engine 315A, a feature extraction engine 315B, and/or an authored content engine 315C. In some embodiments, the filtering engine 315A may be similar to the filtering engine 220 of FIG. 2. The filtering engine 315A may filter the audio waveform to remove high frequency signals (e.g., signals above 500 Hz), such that only frequencies that may drive an actuator (e.g., less than 500 Hz) are provided to the actuators. In some embodiments, the filtering engine 315A may filter the audio waveform to allow only a certain band of frequencies to pass. In some embodiments, frequencies in which haptics would cause a threshold amount of audible noise may be avoided (e.g., 200-300 Hz). Filtering may be implemented, for example, using a bandpass filter. The bandpass filter may have certain parameters, e.g., a specified set of frequencies that should be passed through the filter.

In some embodiments, the feature extraction engine 315B may be similar to the feature extraction engine 215 of FIG. 2. Analysis of the audio waveform by the feature extraction engine 315B may be made in the time domain, the frequency domain, by applying a Fourier transform, and/or by applying a Short-Time Fourier Transform. For example, the feature extraction engine 315B may perform feature extraction on the audio waveform to provide as input to haptics generation engine 316. The feature extraction engine 315B may identify and extract any number of features of an audio waveform, such as temporal characteristics, dynamic characteristics, tonal characteristics, and/or instrumental characteristics, including, for example, treble, bass, beat, tempo, time signature, rhythmic patterns, loudness range, change of loudness over time, accents, melodic properties, complexity of harmony, prominent pitch classes, melody, chorus, time, verse, number of instruments, types of instruments, accompaniments, backup, and the like. For example, the feature extraction engine 315B may identify all bass in an audio waveform in order for the haptic actuator 309 to act as a haptic subwoofer. Based on the extracted features, algorithms such as machine learning and artificial intelligence may be employed to further estimate the genre classification and/or emotion of the audio waveform, which can be used to generate the composition of the haptic waveform.

In some embodiments, the authored content engine 315C may be similar to the authored content engine 225 of FIG. 2. The authored content engine 315C may be configured to analyze the attenuated signal to determine whether a manually created haptic waveform corresponding to the audio waveform exists. For example, the authored content engine 315C may use metadata from the audio waveform, audio features from the audio waveform, etc., to identify the audio waveform (e.g., a song name). Once identified, the authored content engine 315C may query a database (either local or remote, e.g., database 311) for a manually created haptic waveform corresponding to the audio waveform. If the manually created haptic waveform exists, the authored content engine 315C may retrieve and/or receive the haptic waveform. In some embodiments, the authored content engine 315C may also allow a user to manually create a haptic waveform, either to save for future use or to apply to the audio waveform.

In some embodiments, audio processing engine 614 may pass the audio waveform directly to the haptics generation engine 616, without application of the filtering engine 315A, the feature extraction engine 315B, and/or the authored content engine 315C. In some embodiments, the haptics generation engine 616 may be similar to the haptics controller 240 of FIG. 2.

The haptics generation engine 316 may be adapted to process an audio waveform (or its extracted features) to generate one or more haptic waveforms. The one or more haptic waveforms may have specified intensities, durations, and frequencies. In an embodiment in which the audio waveform is directly passed to haptics generation engine 316, haptics generation engine 316 may directly convert the audio waveform into a haptic waveform (e.g., by emulating the haptic waveform that would be performed if the audio waveform was passed directly through a haptic actuator). In some embodiments, haptics generation engine 316 may convert particular extracted features into haptic waveforms. For example, haptics generation engine 316 may detect peaks in the intensity profile of an audio waveform and generate discrete haptic actuation taps in synchronization with the peaks. In some embodiments, haptics generation engine 316 may generate high frequency taps corresponding to high pitch audio signals for a sharper haptic sensation, and/or low frequency taps corresponding to low pitch audio signals. In another example, haptics generation engine 316 may detect the onset times of the audio waveform and generate haptic actuation taps in synchronization with the onset times. In still another example, haptics generation engine 316 may convert the treble portion of an audio waveform into a first haptic waveform, the bass portion of an audio waveform into a second haptic waveform, and the beat of an audio waveform into a third haptic waveform. In some embodiments, haptics generation engine 316 may directly map frequencies of the audio waveform to frequencies for haptic waveforms. In some embodiments, haptics generation engine 316 may map audio signals with frequencies between 20 Hz and 20 kHz to haptic signals with frequencies between 80 Hz and 300 Hz. For example, haptics generation engine 316 may map a 20 Hz audio signal to an 80 Hz haptic signal, and a 20 kHz audio signal to a 300 Hz haptic signal.

In some embodiments in which multiple haptic actuators 309 are present in the electronic device 300, haptics generation engine 316 may generate the same haptic waveform for all of the haptic actuators 309. In some embodiments, haptics generation engine 316 may generate different haptic waveforms for particular haptic actuators 309 (e.g., based on type of haptic actuator 309, location of haptic actuator 309, strength of haptic actuator 309, etc.). For example, each haptic actuator 309 may target a different audio frequency domain, e.g., one haptic actuator 309 acts as a tweeter, while another haptic actuator 309 acts as a woofer. In another example, each haptic actuator 309 may target a different musical instrument, e.g., one haptic actuator 309 may correspond to piano, while another haptic actuator 309 corresponds to violin.

In some embodiments, haptics generation engine 316 generates haptic waveforms considering any of a number of factors. Exemplary factors include the capabilities of haptic actuator 309 in electronic device 300, the number of haptic actuators 309 in electronic device 300, the type of haptic actuators 309 in electronic device 300, and/or the location of haptic actuators 309 in electronic device 300.

In some embodiments, haptics generation engine 316 may determine the capabilities of haptic actuator 309. Exemplary capabilities include drive (DC or AC), drive voltage, frequency (e.g., a resonant frequency in the case of an LRA), amplitude, power consumption, response time, vibration strength, bandwidth and the like. For example, the haptic actuator 309 having the highest vibration strength may be assigned a haptic waveform generated based on the bass of an audio waveform if the audio waveform has a very prominent bass track. In another example, all haptic actuators 309 having a higher vibration strength than a threshold may be assigned a haptic waveform generated based on the beat of an audio waveform if the audio waveform has a very strong beat.

In some embodiments, haptics generation engine 316 may determine the number of haptic actuators 309 in the electronic device 300. In some embodiments, haptics generation engine 316 may determine the type of electronic device 300. Exemplary types of electronic devices 300 include mobile phones, MP3 players, headphones, watches, fitness bands, wearable actuators, and the like. For example, if electronic device 300 is a fitness band (as opposed to a mobile phone), the a stronger haptic waveform may be generated for the electronic device 300 because it may likely have less contact with the user.

In some embodiments, haptics generation engine 316 may determine the location of haptic actuators 309 within the electronic device 300 and with respect to the user of the electronic device 300. The contact location of the electronic device 300 with a user may be determined according to one or more of a variety of methods. The contact location of the electronic device 300 may be relevant due to differing sensitivities of certain body areas, for example. In some embodiments, the contact location of the electronic device 300 may be determined using localization methods, such as, for example, ultra wide band RF localization, ultrasonic triangulation, and/or the like. In some embodiments, the contact location of the electronic device 300 may be inferred from other information, such as the type of the electronic device 300. For example, if the electronic device 300 is a watch, haptics generation engine 316 may infer that the electronic device 300 is located on the wrist. In another example, if the electronic device 300 is headphones, haptics generation engine 316 may infer that the electronic device 300 is located on the head. In some embodiments, the user may be prompted to select or enter the location of the electronic device 300. In some embodiments, if the electronic device 300 has accelerometers, gyroscopes, and/or other sensors, the contact location of the electronic device 300 may be determined from motion signatures. For example, if the electronic device 300 has a motion signature corresponding to forward motions with regular, relatively stationary breaks in between, haptics generation engine 316 may determine that the electronic device 300 is located on the leg while the user is walking. In one example, if it is determined that the electronic device 300 is in a front pocket, a strong haptic waveform may be generated for the electronic device 300 because the front hip is not typically sensitive to vibrations. In another example, if it is determine that the electronic device 300 is on the left side of the body, a left channel audio waveform may be used to synthesize a haptic waveform for the electronic device 300. In considering location of the haptic actuators 309 and the electronic device 300, haptics generation engine 316 may also consider whether it may produce a sensory saltation effect to create phantom sensations in some examples. In these examples, the perceived stimulation can be elsewhere from the locations in contact with the electronic device 300.

It is contemplated that haptics generation engine 316 may consider any of a number of other factors as well. For example, haptics generation engine 316 may consider whether the electronic device 300 uses haptic actuator 309 for other functions as well, such as notifications (e.g., alerts, calls, etc.). In these embodiments, haptics generation engine 316 may generate haptic waveforms that do not interfere with existing haptic notifications. For example, if the electronic device 300 uses a strong, quick vibration that repeats three times for a text message, haptics generation engine 316 may use vibrations with lower strengths and/or vibrations that do not repeat in the same frequency or at the same time, so as not to confuse a user between the haptic waveform and the haptic notification. In some embodiments, the haptic waveform may be modulated, paused or otherwise manipulated to allow for or complement the existing haptic functions of the electronic device 300 (e.g., notifications and alerts).

Haptics generation engine 316 may also generate new haptic waveforms or modify existing haptic waveforms based on any of these factors changing. For example, haptics generation engine 316 may generate new haptic waveforms for the electronic device 300 when one of the haptic actuators 309 is disabled (e.g., it has an error or malfunctions). The new haptic waveforms may compensate for the haptic waveform that was lost from the other haptic actuator 309. For example, if one haptic actuator 309 was performing a haptic waveform corresponding to the bass of an audio waveform, that haptic waveform can instead be incorporated into the haptic waveform for another haptic actuator 309. In another example, the original haptic waveforms for the remaining haptic actuator 309 of the electronic device 300 may remain unchanged. Similarly, haptics generation engine 316 may generate a new haptic waveform for a new haptic actuator 309 when a new haptic actuator 309 is detected or installer. The new haptic waveform may be generated to bolster the existing haptic waveforms being performed by the electronic device 300, and/or the new haptic waveform may be assigned a particular portion of a corresponding audio waveform and the existing haptic waveforms may be modified accordingly.

In some embodiments, haptics generation engine 316 may not be necessary. For example, an artist, manufacturer or other entity associated with an audio waveform may provide one or more haptic waveforms to accompany a given audio waveform. In those embodiments, the haptic waveform does not need to be generated. Such embodiments may be described herein with respect to authored content engine 315C.

Audio performance engine 318 may be configured to perform the audio waveform on the electronic device 300, such as through speaker 310. Although shown and described as being performed on the electronic device 300, however, it is contemplated that another device (e.g., another device in communication with the electronic device 300) may alternatively or additionally perform the audio waveform. Audio performance engine 318 may alternatively or additionally perform the functions associated with speaker protection circuit 255, amplifier 260, speaker protection circuit 270, and/or amplifier 275 of FIG. 2 in some embodiments.

Haptics performance engine 320 may be configured to perform a haptic waveform on the electronic device 300, such as by using haptic actuator 309. Although shown and described as being performed on the electronic device 300, however, it is contemplated that in some embodiments, the electronic device 300 may not perform a haptic waveform, and that haptic waveforms may be performed solely by one or more other devices, as described further herein.

Audio-haptics synchronization engine 322 may be adapted to coordinate performance of the audio waveform and performance of the haptic waveform(s) generated by haptics generation engine 316. In embodiments in which the audio waveform is stereophonic, the audio-haptics synchronization engine 322 may be configured to coordinate performance of the left and right components of the audio waveform by left and right speakers 310, along with performance of the haptics waveform(s) by the haptic actuator 309.

Figure 4:
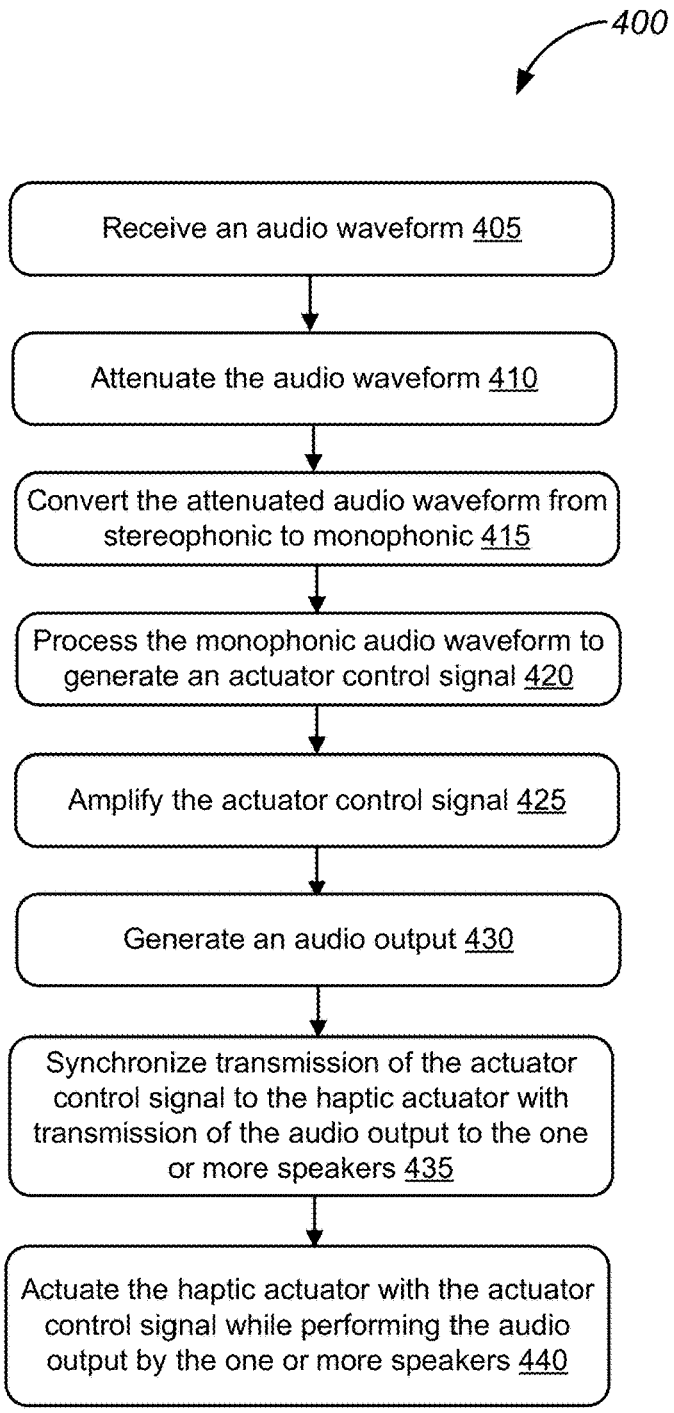
FIG. 4 shows a flow diagram of a method for processing an audio waveform to produce haptics in accordance with some embodiments of the disclosure.

FIG. 4 shows a flow diagram 400 of a method for processing an audio waveform to produce haptics in accordance with some embodiments of the disclosure. At step 405, an audio waveform may be received. The audio waveform may be received by an electronic device including at least one speaker and at least one haptic actuator. The electronic device may be, for example, electronic device 300 of FIG. 3, or any of the devices described herein. In some embodiments, the audio waveform may be stereophonic. In some embodiments, the haptic actuator may be a linear actuator.

At step 410, the audio waveform may be attenuated. For example, the signal strength of the audio waveform may be diminished or increased in order to make the audio waveform more suitable for haptics processing. Attenuation in this step may serve one or more of several purposes. For example, attenuation may perceptually scale the haptics in relation to the audio volume. In another example, attenuation may account for energy and thermal restrictions. In still another example, attenuation may account for haptic actuator limitations (e.g., excess noise, poor efficiency regions, power limitations at certain frequencies, etc.).

At step 415, the attenuated audio waveform is converted from stereophonic to monophonic. This may be done by a stereo to mono signal converter, such as stereo to mono converter 230 of FIG. 2. In other words, the attenuated audio waveform may be converted from two signals into one signal, and/or from two audio channels into one audio channel.

At step 420, the monophonic audio waveform may be processed to generate an actuator control signal. The actuator control signal may also be referred to herein as a "haptic waveform". In some embodiments, processing the monophonic audio waveform to generate the actuator control signal may include filtering the monophonic audio waveform, such as by the filtering engine 315A of FIG. 3. The monophonic audio waveform may be filtered using a bandpass filter. In some embodiments, processing the monophonic audio waveform to generate the actuator control signal may include extracting one or more features from the monophonic audio waveform, such as by the feature extraction engine 315B of FIG. 3, and applying one or more haptic elements to the feature to generate a haptic waveform. In some embodiments, processing the monophonic audio waveform to generate the actuator control signal may include receiving user input defining the actuator control signal, such as by the authored content engine 315C of FIG. 3. In some embodiments, processing the monophonic audio waveform to generate the actuator control signal may include retrieving the actuator control signal from a database, such as by the authored content engine 315C of FIG. 3.

In some embodiments, the actuator control signal may be modified based on an environmental context of the electronic device (e.g., a location of the electronic device, a motion of the electronic device, an orientation of the electronic device, a contact amount of the electronic device to a user, etc.). For example, if the electronic device is in a charging dock or mounted in a car, the actuator control signal may be modified or eliminated. Similarly, if the electronic device is not in contact with the user (e.g., is on a table, in a purse, etc.), the actuator control signal may be modified or eliminated. Still further, if the electronic device is on a leg as opposed to on an ear of the user, the actuator control signal may be increased as the leg may be less sensitive to haptics than the ear. Still further, if the electronic device is in a case in a user's pocket, the actuator control signal may be increased as less vibration may be felt through the case.

In some embodiments, the actuator control signal may be modified based on a type of the audio waveform. The type of the audio waveform may include an artist, a genre, an album, and/or any other predefined metadata associated with the audio waveform. For example, if the audio waveform corresponds to heavy metal music, the actuator control signal may be increased in intensity as compared to an audio waveform corresponding to classical violin music.

In some embodiments, the actuator control signal may be modified based on a source of the audio waveform. For example, if the audio waveform originated from an action role playing game, the actuator control signal may be intensified to enhance the experience of explosions and the like. In another example, if the audio waveform originated from a podcast, the actuator control signal may be decreased or eliminated, as haptic enhancement of voiceovers may not be desirable.

Sources of audio waveforms may include video games, augmented reality applications, virtual reality applications, music creation applications, podcasts, audio books, music playback applications, video applications, and/or the like. With respect to music creation applications, a haptic actuator may generate vibrations when a virtual drumstick is used to hit a virtual snare. Similarly, a haptic actuator may generate vibrations when a virtual piano is played.

With respect to augmented reality and virtual reality applications, for example, the actuator control signal may be modified based on the user's virtual or actual proximity to sources of sound. For example, a virtual explosion viewed on the virtual horizon may generate minimal vibration, while a virtual explosion underneath the user in the virtual environment may generate maximum vibration. Similarly, the actuator control signal may be modified based on the user's position with respect to sources of sound. For example, if a virtual explosion occurs to a user's left in the virtual environment, a left sided haptic actuator may be vibrated, while if the virtual explosion occurs to a user's right in the virtual environment, a right sided haptic actuator may be vibrated. Thus, directionality may be used to modify the actuator control signal and mimic directionality in the virtual environment.

In some embodiments, the actuator control signal may be modified based user preferences. For example, a user may define a profile of preferences with respect to haptics. The profile of preferences may describe the intensity of the desired haptics, the location of the desired haptics, the features of the audio waveform desired to be accentuated by haptics (e.g., bass), when and/or to what to apply haptics, when and/or to what not to apply haptics, etc.

At step 425, the actuator control signal may be amplified. At step 430, an audio output may be generated using the audio waveform at the one or more speakers. At step 435, transmission of the actuator control signal may be synchronized with transmission of the audio output to the one or more speakers. At step 440, the haptic actuator may be actuated with the actuator control signal while performing the audio output by the one or more speakers. In some embodiments, the electronic device may include an input element (e.g., included in user interface 307 of FIG. 3). User input may be received from the input element, and vibration of the electronic device may be adjusted or modified based on the user input.

Augmented Performance Synchronized Amongst Multiple Devices

According to some embodiments, augmented performance may also be synchronized amongst multiple devices. Turning back to FIG. 1, mobile device 105 may be a host device, while headphones 110 and watch 115 may be slave devices. Mobile device 105 may be transmitting an audio waveform (e.g., a song) to headphones 110. Headphones 110 may be outputting the audio waveform to user 100. Mobile device 105 may also be transmitting haptic waveforms to headphones 110 and watch 115. Mobile device 105 may also have its own haptic waveform. The haptic waveforms may correspond to the audio waveform and may be the same or different than each other, depending on one or more factors as described further herein. Mobile device 105 may be synchronizing performance of the audio waveform with the haptic waveforms to provide user 100 with an augmented listening experience.

Figure 5:
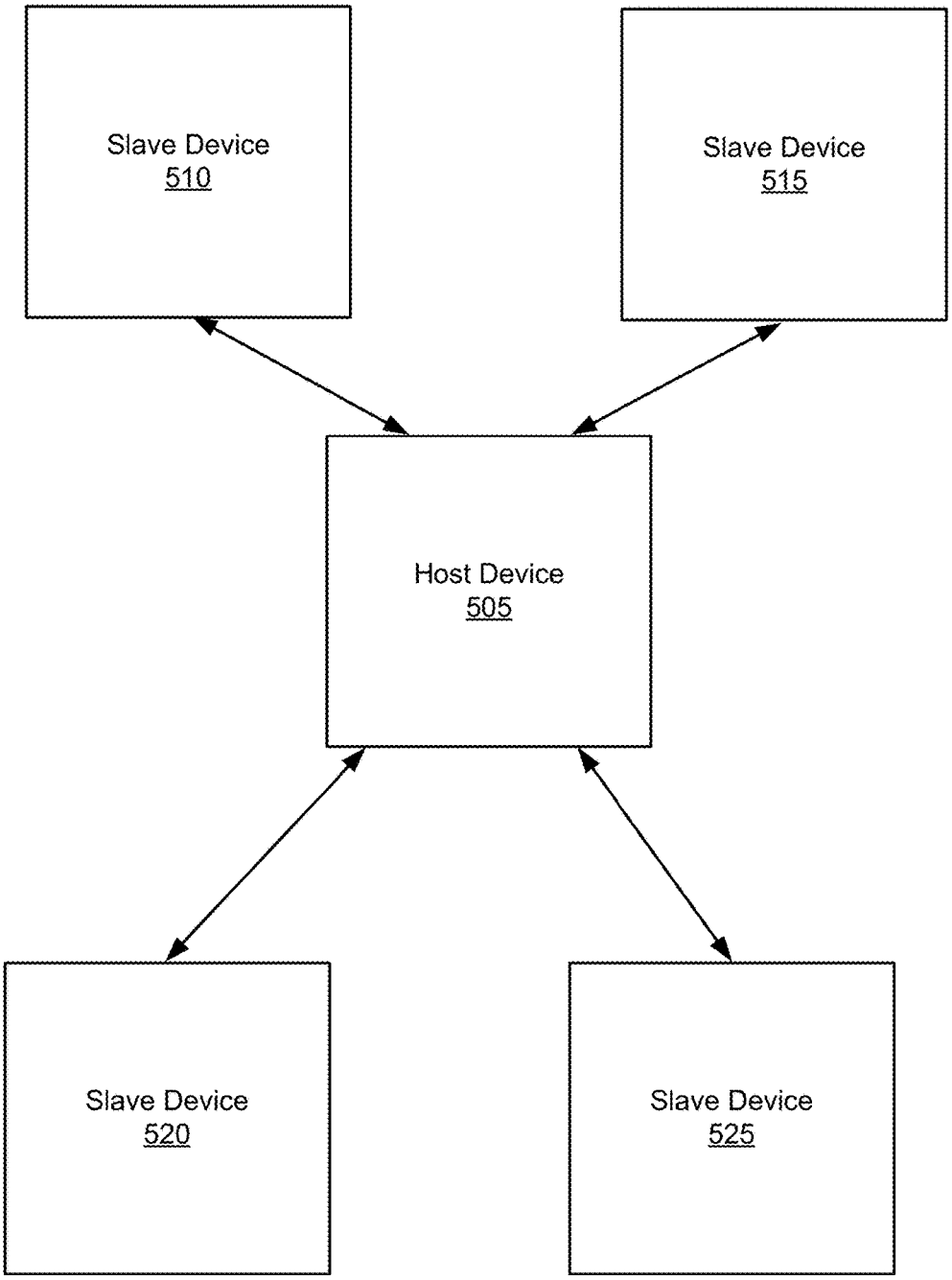
FIG. 5 shows a block diagram of a host device in communication with multiple slave devices in accordance with some embodiments of the disclosure.

Reference is now made to FIG. 5, which depicts a block diagram of a system of devices according to some embodiments of the present invention. The system includes a host device 505 in communication with four slave devices 510, 515, 520, 525. Although shown and described as being in communication with four slave devices 510, 515, 520, 525, it is contemplated that host device 505 may be in communication with any number of slave devices. The communication between host device 505 and each of slave devices 510, 515, 520, 525 may be unidirectional (i.e., from host to slave) or bidirectional (i.e., between host and slave). In addition, in some embodiments, some or all of slave devices 510, 515, 520, 525 may be adapted to communicate with each other unidirectionally or bidirectionally. In some embodiments, communication between host device 505 and slave devices 510, 515, 520, 525 is wireless. In some embodiments, host device 505, slave device 510, slave device 515, slave device 520, and/or slave device 525 may be operated by the same user, or may be operated by two or more different users.

Host device 505 may be any electronic device adapted to receive, process, generate, and/or output waveforms, and to coordinate with slave devices 510, 515, 520, 525. For example, host device 505 may be an electronic device adapted to retrieve an audio waveform. In some embodiments, host device 505 may be electronic device 300 of FIG. 3 and/or may include one or more elements of electronic device 300. The audio waveform may be a song retrieved from memory, for example. In another example, the audio waveform may be audio recorded either previously or in real-time by a microphone.

Host device 505 may further be adapted to process the waveform to generate other waveforms, and send the other waveforms to slave devices 510, 515, 520, 525. For example, an audio waveform may be processed to generate haptic waveforms according to direct conversion (i.e., by creating a haptic waveform based on direct driving of the audio waveform through an actuator) or indirect conversion. For example, indirection conversion may include performing feature extraction of the audio waveform and creating haptic waveform elements based on the extracted features. The haptic waveforms generated for slave devices 510, 515, 520, 525 may be the same or different than each other based upon any of a number of factors, as described further herein. Host device 505 may further generate a haptic waveform for itself (i.e., to be output by an actuator of host device 505) in some embodiments. In other embodiments, host device 505 may generate haptic waveforms only for slave devices 510, 515, 520, 525.

Host device 505 may further be adapted to synchronize outputting of the waveforms. For example, host device 505 may synchronize outputting of an audio waveform with outputting of haptic waveforms by slave devices 510, 515, 520, 525 and/or host device 505. The audio waveform may be output by host device 505 or by any of slave devices 510, 515, 520, 525 (e.g., by headphones or a speaker). The waveforms may be synchronized in that the timing of the audio waveform and the haptic waveforms align, providing a coordinated and immersive listening experience across host device 505 and slave devices 510, 515, 520, 525.

Figure 6:
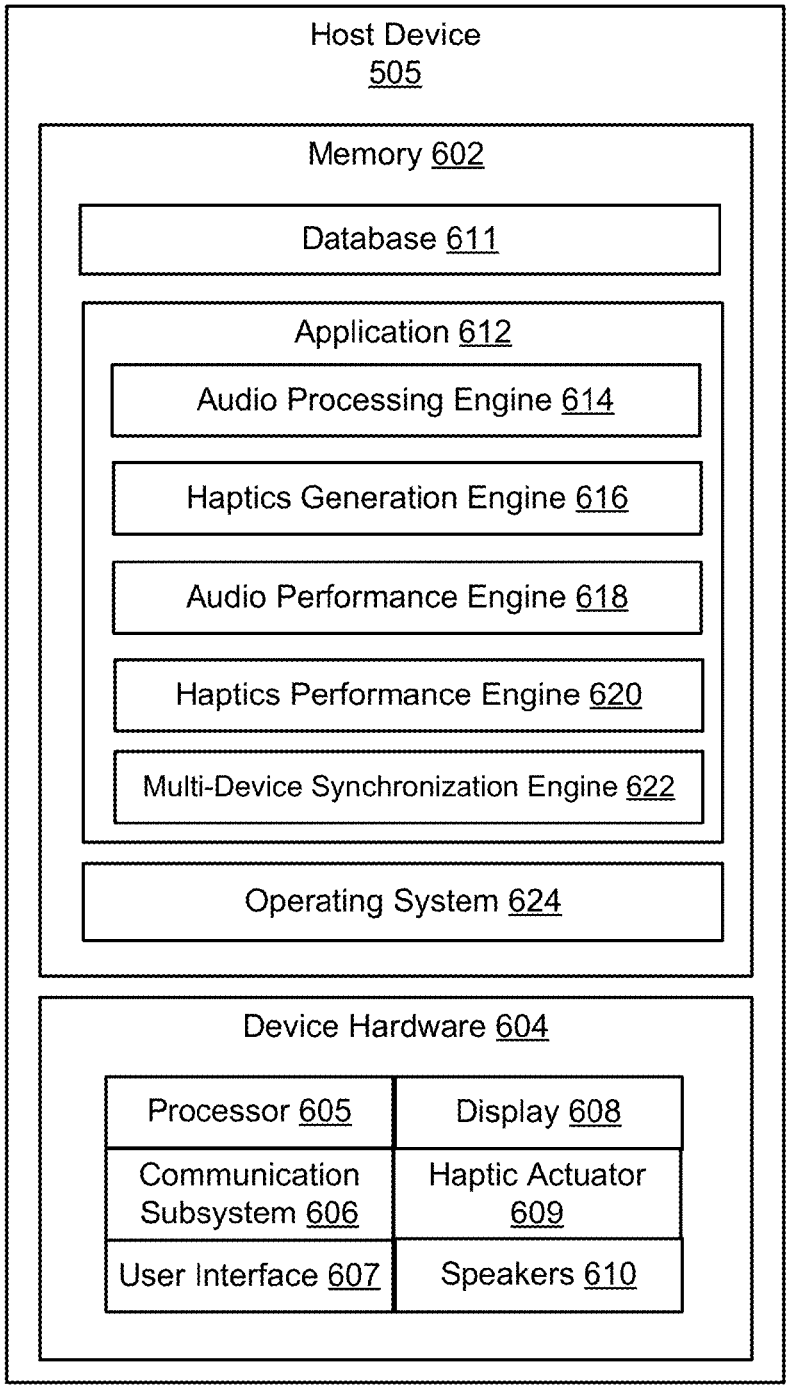
FIG. 6 shows a block diagram of a host device in accordance with some embodiments of the disclosure.

Reference is now made to FIG. 6, which depicts a block diagram of a host device 505 according to some embodiments of the present invention. Although shown and described as having a certain number and type of components, it is contemplated that any combination of these components may exist in host device 505, and not all are required. For example, host device 505 may not include a haptic actuator 609 in some embodiments in which host device 505 is coordinating the performance of haptic waveforms only be slave devices. In addition, additional components not shown may be included in host device 505.

Host device 505 may include device hardware 604 coupled to a memory 602. Device hardware 604 may include a processor 605, a communication subsystem 606, a user interface 607, a display 608, a haptic actuator 609, and speakers 610. Processor 605 may be implemented as one or more integrated circuits (e.g., one or more single core or multicore microprocessors and/or microcontrollers), and is used to control the operation of host device 505. Processor 605 may execute a variety of programs in response to program code or computer-readable code stored in memory 602, and can maintain multiple concurrently executing programs or processes.

Communications subsystem 606 may include one or more transceivers (communicating via, e.g., radio frequency, WiFi, Bluetooth, Bluetooth LE, IEEE 802.11, etc.) and/or connectors that can be used by host device 505 to communicate with other devices (e.g., slave devices) and/or to connect with external networks. Communications subsystem 606 may also be used to detect other devices in communication with host device 505.

User interface 607 may include any combination of input and output elements to allow a user to interact with and invoke the functionalities of host device 505. In some embodiments, user interface 607 may include a component such as display 608 that can be used for both input and output functions. User interface 607 may be used, for example, to turn on and tuff off the audio augmentation functions of application 612. User interface 607 may also be used, for example, to select which of host device 505 and/or the communicating slave devices should be used for the audio augmentation functions of application 612. In some embodiments, user interface 607 may be used to control haptics functions of a slave device 510 (e.g., turning haptics on or off, controlling intensity of the haptics, etc.).

Haptic actuator 609 may be any component capable of creating forces, pressures, vibrations and/or motions sensible by a user. For example, haptic actuator 609 may be an eccentric rotating mass (ERM) motor or a linear resonant actuator (LRA). Haptic actuator 609 may comprise electromagnetic, piezoelectric, magnetostrictive, memory alloy, and/or electroactive polymer actuators. Haptic actuator 609 may have any of a number of capabilities, such as a drive (DC or AC), drive voltage, a frequency (e.g., a resonant frequency in the case of an LRA), an amplitude, a power consumption, a response time, a vibration strength, a bandwidth and the like. Haptic actuator 609 may be a single frequency actuator or a wide band actuator. A single frequency actuator may have varied momentum, strength, and/or intensity, whereas a wide band actuator may vary in frequency. Although shown and described as having only one haptic actuator 609, it is contemplated that host device 505 may include any number of haptic actuators at any locations within host device 505. Speakers 610 may be any component capable of outputting audio.

Memory 602 may be implemented using any combination of any number of non-volatile memories (e.g., flash memory) and volatile memories (e.g., DRAM, SRAM, etc.), or any other non-transitory storage medium, or a combination thereof. Memory 602 may store an operating system 624, a database 611, and an application 612 to be executed by processor 605.

Application 612 may include an application that receives, processes, generates, outputs, and/or synchronizes waveforms. Application 612 may include an audio processing engine 614, a haptics generation engine 616, an audio performance engine 618, a haptics performance engine 620, and a multi-device synchronization engine 622.

The audio processing engine 614 may be adapted to retrieve and process an audio waveform. In some embodiments, the audio waveform may be retrieved from database 611 of host device 505 (i.e., the audio waveform is already stored in host device 505). In some embodiments, the audio waveform may be retrieved from another device (e.g., a slave device). For example, host device 505 may retrieve an audio waveform that is stored locally on an external MP3 player. In some embodiments, the audio waveform may be retrieved from a remote server (e.g., a music streaming server). In some embodiments, the audio waveform may be retrieved in real-time from a component of device hardware 604 (e.g., a microphone).

Audio processing engine 614 may further process and analyze the audio waveform in some embodiments. Analysis of the audio waveform may be made in the time domain, the frequency domain, by applying a Fourier transform, and/or by applying a Short-Time Fourier Transform. For example, audio processing engine 614 may perform feature extraction on the audio waveform to provide as input to haptics generation engine 616. Feature extraction may identify and extract any number of features of an audio waveform, such as temporal characteristics, dynamic characteristics, tonal characteristics, and/or instrumental characteristics, including, for example, treble, bass, beat, tempo, time signature, rhythmic patterns, loudness range, change of loudness over time, accents, melodic properties, complexity of harmony, prominent pitch classes, melody, chorus, time, verse, number of instruments, types of instruments, accompaniments, backup, and the like. Based on the extracted features, algorithms such as machine learning and artificial intelligence may be employed to further estimate the genre classification and/or emotion of the audio waveform, which can be used to generate the composition of the haptic waveform.

In some embodiments, audio processing engine 614 may pass the audio waveform directly to the haptics generation engine 616. In some embodiments, audio processing engine 614 may filter the audio waveform to remove high frequency signals (e.g., signals above 500 Hz), such that only frequencies that may drive an actuator (e.g., less than 500 Hz) are provided to the actuators. Filtering may be implemented, for example, using a band pass filter.

The haptics generation engine 616 may be adapted to process an audio waveform (or its extracted features) to generate one or more haptic waveforms. The one or more haptic waveforms may have specified intensities, durations, and frequencies. In an embodiment in which the audio waveform is directly passed to haptics generation engine 616, haptics generation engine 616 may directly convert the audio waveform into a haptics waveform (e.g., by emulating the haptic waveform that would be performed if the audio waveform was passed directly through a haptic actuator). In some embodiments, haptics generation engine 616 may convert particular extracted features into haptic waveforms. For example, haptics generation engine 616 may detect peaks in the intensity profile of an audio waveform and generate discrete haptic actuation taps in synchronization with the peaks. In some embodiments, haptics generation engine 616 may generate high frequency taps corresponding to high pitch audio signals for a sharper haptic sensation, and/or low frequency taps corresponding to low pitch audio signals. In another example, haptics generation engine 616 may detect the onset times of the audio waveform and generate haptic actuation taps in synchronization with the onset times. In still another example, haptics generation engine 616 may convert the treble portion of an audio waveform into a first haptic waveform, the bass portion of an audio waveform into a second haptic waveform, and the beat of an audio waveform into a third haptic waveform. In some embodiments, haptics generation engine 616 may directly map frequencies of the audio waveform to frequencies for haptic waveforms. In some embodiments, haptics generation engine 616 may map audio signals with frequencies between 20 Hz and 20 kHz to haptic signals with frequencies between 80 Hz and 300 Hz. For example, haptics generation engine 616 may map a 20 Hz audio signal to an 80 Hz haptic signal, and a 20 kHz audio signal to a 300 Hz haptic signal.

In some embodiments, haptics generation engine 616 generates the same haptic waveform for all of the slave devices and the host device 505. In some embodiments, haptics generation engine 616 may generate different haptic waveforms for particular devices (e.g., slave devices and host device 505). For example, each device may target a different audio frequency domain, e.g., one slave device acts as a tweeter, while another slave device acts as a woofer. In another example, each device may target a different musical instrument, e.g., host device 505 may correspond to piano, while a slave device corresponds to violin.

In some embodiments, haptics generation engine 616 generates haptic waveforms considering any of a number of factors. Exemplary factors include the capabilities of haptic actuator 609 in host device 505, the capabilities of haptic actuators in the slave devices, the number of devices having haptic actuators, the number of actuators within each device, the type of devices having haptic actuators, and/or the location of devices having haptic actuators.

In some embodiments, haptics generation engine 616 may determine the capabilities of haptic actuator 609 and/or the capabilities of actuators within slave devices. The capabilities of actuators within slave devices may be determined by communicating with the slave devices via communication subsystem 606. Exemplary capabilities include drive (DC or AC), drive voltage, frequency (e.g., a resonant frequency in the case of an LRA), amplitude, power consumption, response time, vibration strength, bandwidth and the like. For example, the device with the actuator having the highest vibration strength may be assigned a haptic waveform generated based on the bass of an audio waveform if the audio waveform has a very prominent bass track. In another example, all of the devices with actuators having a higher vibration strength than a threshold may be assigned a haptic waveform generated based on the beat of an audio waveform if the audio waveform has a very strong beat.

In some embodiments, haptics generation engine 616 may determine the number of devices that have actuators (i.e., slave devices and/or host device 505). The number of slave devices having actuators may be determined by communicating with the slave devices via communication subsystem 606. For example, if there is only one slave device that has an actuator, haptics generation engine 616 may generate a haptic waveform corresponding directly to the audio waveform such that all parts of the audio waveform may be performed by the single actuator. In another example, if there are two slave devices that have actuators, haptics generation engine 616 may generate a first haptic waveform corresponding to the treble of an audio waveform for the first slave device, and a second haptic waveform corresponding to the bass of an audio waveform for the second slave device.

In some embodiments, haptics generation engine 616 may determine the number of actuators in each device (e.g., slave devices and/or host device 505). The number of actuators in each slave device may be determined by communicating with the slave devices via communication subsystem 606. For example, if a slave device has two haptic actuators, haptics generation engine 616 may generate two separate haptic waveforms having different features to be performed by the two haptic actuators to further enhance the tactile effect of the two actuators.

In some embodiments, haptics generation engine 616 may determine the type of devices having actuators (e.g., slave devices and/or host device 505). The type of each slave device may be determined by communicating with the slave devices via communication subsystem 606. Exemplary types of devices include mobile phones, MP3 players, headphones, watches, fitness bands, wearable actuators, and the like. For example, if host device 505 is a mobile phone while the slave devices are wearable actuators, the strongest haptic waveform may be generated for the host device 505 because it may likely have the most contact with the user. In another example, if host device 505 is a mobile phone while the slave device is a watch, the strongest haptic waveform may be generated for host device 505 because its contact with the user may be indirect (e.g., through a pocket, and thus, the tactile effect may be attenuated).

In some embodiments, haptics generation engine 616 may determine the location of devices having actuators (e.g., slave devices and/or host device 505). The location of each slave device may be determined by communicating with the slave devices via communication subsystem 606. The contact location of the devices with a user may be determined according to one or more of a variety of methods. The contact location of the devices may be relevant due to differing sensitivities of certain body areas, for example. In some embodiments, the contact location of the devices may be determined using localization methods, such as, for example, ultra wide band RF localization, ultrasonic triangulation, and/or the like. In some embodiments, the contact location of the devices may be inferred from other information, such as the type of the device. For example, if the device is a watch, haptics generation engine 616 may infer that the device is located on the wrist. In another example, if the device is headphones, haptics generation engine 616 may infer that the device is located on the head. In some embodiments, the user may be prompted to select or enter the location of the slave devices and/or host device 505. In some embodiments, for devices that have accelerometers, gyroscopes, and/or other sensors, the contact location of the devices may be determined from motion signatures. For example, if a device has a motion signature corresponding to forward motions with regular, relatively stationary breaks in between, haptics generation engine 616 may determine that the device is located on the leg while the user is walking. In one example, if it is determined that host device 505 is in a front pocket, a strong haptic waveform may be generated for host device 505 because the front hip is not typically sensitive to vibrations. In another example, if it is determine that one slave device is on the left side of the body, a left channel audio waveform may be used to synthesize a haptic waveform for that slave device, while a right channel audio waveform may be used to synthesize a haptic waveform for a slave device on the right side of the body. In considering location of the devices, haptics generation engine 616 may also consider whether it may produce a sensory saltation effect to create phantom sensations in some examples. In these examples, the perceived stimulation can be elsewhere from the locations in contact with the devices.

It is contemplated that haptics generation engine 616 may consider any of a number of other factors as well. For example, haptics generation engine 616 may consider whether host device 505 and/or any of the slave devices use their respective haptic actuators for other functions as well, such as notifications (e.g., alerts, calls, etc.). In these embodiments, haptics generation engine 616 may generate haptic waveforms that do not interfere with existing haptic notifications. For example, if host device 505 uses a strong, quick vibration that repeats three times for a text message, haptics generation engine 616 may use vibrations with lower strengths and/or vibrations that do not repeat in the same frequency or at the same time, so as not to confuse a user between the haptic waveform and the haptic notification. In some embodiments, the haptic waveform may be modulated, paused or otherwise manipulated to allow for or complement the existing haptic functions of the devices (e.g., notifications and alerts).

Haptics generation engine 616 may also generate new haptic waveforms or modify existing haptic waveforms based on any of these factors changing. For example, haptics generation engine 616 may generate new haptic waveforms for host device 505 and one slave device when communication is lost with a second slave device (e.g., it is turned off, has an error, or goes out of range). The new haptic waveforms may compensate for the haptic waveform that was lost from the second slave device. For example, if the second slave device was performing a haptic waveform corresponding to the bass of an audio waveform, that haptic waveform can instead be incorporated into the haptic waveform for the host device 505 or the other slave device. In another example, the original haptic waveforms for host device 505 and the remaining slave device may remain unchanged. Similarly, haptics generation engine 616 may generate a new haptic waveform for a new slave device when communication is established with a second slave device (e.g., it is turned on or comes into range). The new haptic waveform may be generated to bolster the existing haptic waveforms being performed by host device 505 and the first slave device, and/or the new haptic waveform may be assigned a particular portion of a corresponding audio waveform and the existing haptic waveforms may be modified accordingly.

In some embodiments, haptics generation engine 616 may not be necessary. For example, an artist, manufacturer or other entity associated with an audio waveform may provide one or more haptic waveforms to accompany a given audio waveform. In those embodiments, the haptic waveform does not need to be generated.

Audio performance engine 618 may be adapted to perform the audio waveform on host device 505, such as through speakers 610. Although shown and described as being performed on host device 505, however, it is contemplated that another device (e.g., a slave device or other device in communication with host device 505) may alternatively or additionally perform the audio waveform.

Haptics performance engine 620 may be adapted to perform a haptic waveform on host device 505, such as by using haptic actuator 609. Although shown and described as being performed on host device 505, however, it is contemplated that in some embodiments, host device 505 may not perform a haptic waveform, and that haptic waveforms may be performed solely by one or more slave devices. In such embodiments, host device 505 may be coordinating the performance of haptic waveforms by slave devices, without performing a haptic waveform itself.

Synchronization engine 622 may be adapted to coordinate performance of the audio waveform and performance of the haptic waveforms generated by haptics generation engine 616. For example, synchronization engine 622 may transmit the haptic waveforms to one or more slave devices, and may communicate with the slave devices to synchronize the performance of the haptic waveforms with the audio waveform. In some embodiments, synchronization engine 622 may also transmit the audio waveform to a slave device for performance by a slave device. In other embodiments, synchronization engine 622 may transmit the audio waveform to audio performance engine 618 for performance by speakers 610.

Synchronization engine 622 may further be adapted to coordinate the hosting functions of host device 505. For example, synchronization engine 622 may receive a command to cease hosting functions of host device 505 (e.g., a command to shut down). Synchronization engine 622 may then communicate with the slaves devices via communication subsystem 606 to determine whether any of the slave devices are capable of performing the hosting functions (e.g., have an audio processing engine 614, a haptics generation engine 616, and/or a synchronization engine 622). If a slave device is found that is capable of performing the hosting functions, synchronization engine 622 may designate that slave device as a host device and pass the hosting duties to the new host device. The augmented listening experience may then continue with the new host device.

Figure 7:
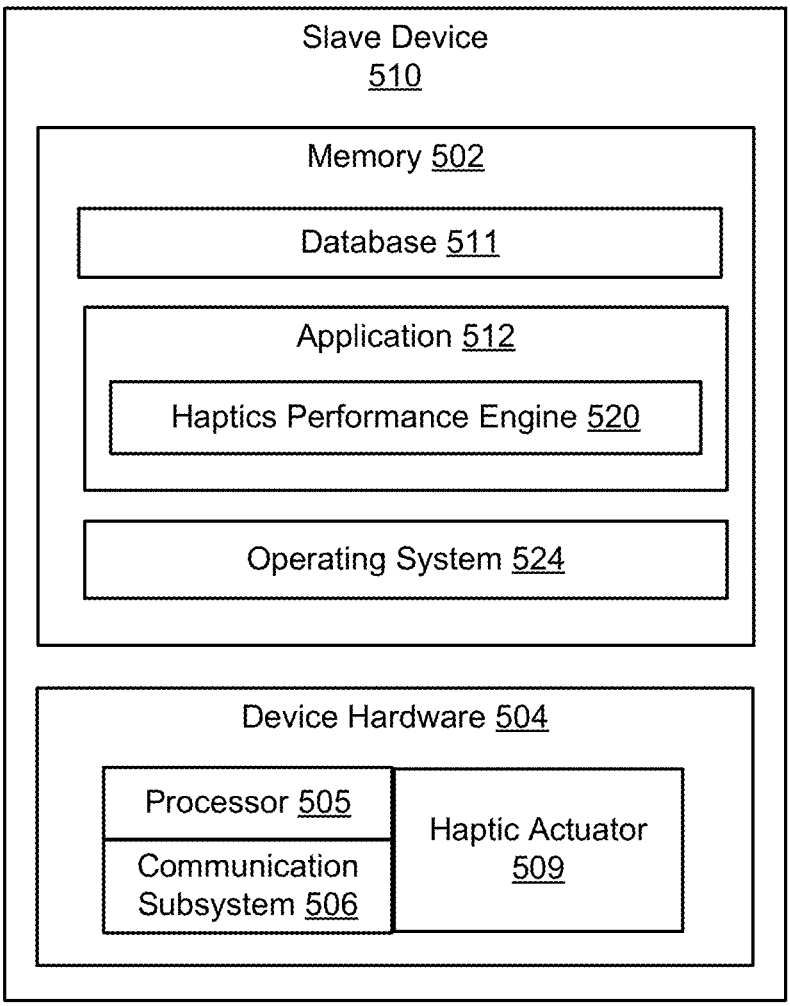
FIG. 7 shows a block diagram of a slave device in accordance with some embodiments of the disclosure.

Reference is now made to FIG. 7, which depicts a block diagram of a slave device 510 according to some embodiments of the present invention. Although shown and described as having a certain number and type of components, it is contemplated that any combination of these components may exist in slave device 510, and not all are required. In addition, additional components not shown may be included in slave device 510.

Slave device 510 may include device hardware 704 coupled to a memory 702. Device hardware 704 may include a processor 705, a communication subsystem 706, and a haptic actuator 709. Processor 705 may be implemented as one or more integrated circuits (e.g., one or more single core or multicore microprocessors and/or microcontrollers), and is used to control the operation of slave device 510. Processor 705 may execute a variety of programs in response to program code or computer-readable code stored in memory 702, and can maintain multiple concurrently executing programs or processes.

Communications subsystem 706 may include one or more (communicating via, e.g., radio frequency, WiFi, Bluetooth, Bluetooth LE, IEEE 802.11, etc.) and/or connectors that can be used by slave device 510 to communicate with other devices (e.g., a host device and/or other slave devices) and/or to connect with external networks. Haptic actuator 709 may be any component capable of creating forces, vibrations and/or motions sensible by a user. For example, haptic actuator 709 may be an eccentric rotating mass (ERM) motor or a linear resonant actuator (LRA). Haptic actuator 709 may have any of a number of capabilities, such as a drive (DC or AC), drive voltage, a frequency (e.g., a resonant frequency in the case of an LRA), an amplitude, a power consumption, a response time, a vibration strength, a bandwidth and the like. Haptic actuator 709 may be a single frequency actuator or a wide band actuator. A single frequency actuator may have varied momentum, strength, and/or intensity, whereas a wide band actuator may vary in frequency. Although shown and described as having only one haptic actuator 709, it is contemplated that slave device 510 may include any number of haptic actuators at any locations within slave device 510.

Memory 702 may be implemented using any combination of any number of non-volatile memories (e.g., flash memory) and volatile memories (e.g., DRAM, SRAM, etc.), or any other non-transitory storage medium, or a combination thereof. Memory 702 may store an operating system 724, a database 711, and an application 712 to be executed by processor 705.

Application 712 may include an application that receives and outputs waveforms. Application 712 may include a haptics performance engine 720. Haptics performance engine 720 may be adapted to receive a haptic waveform from a host device (e.g., host device 505) and perform the haptic waveform on slave device 510, such as by using haptic actuator 709. Performance of the haptic waveform by haptics performance engine 720 may be coordinated and synchronized by the host device (e.g., host device 505).

Figure 8:
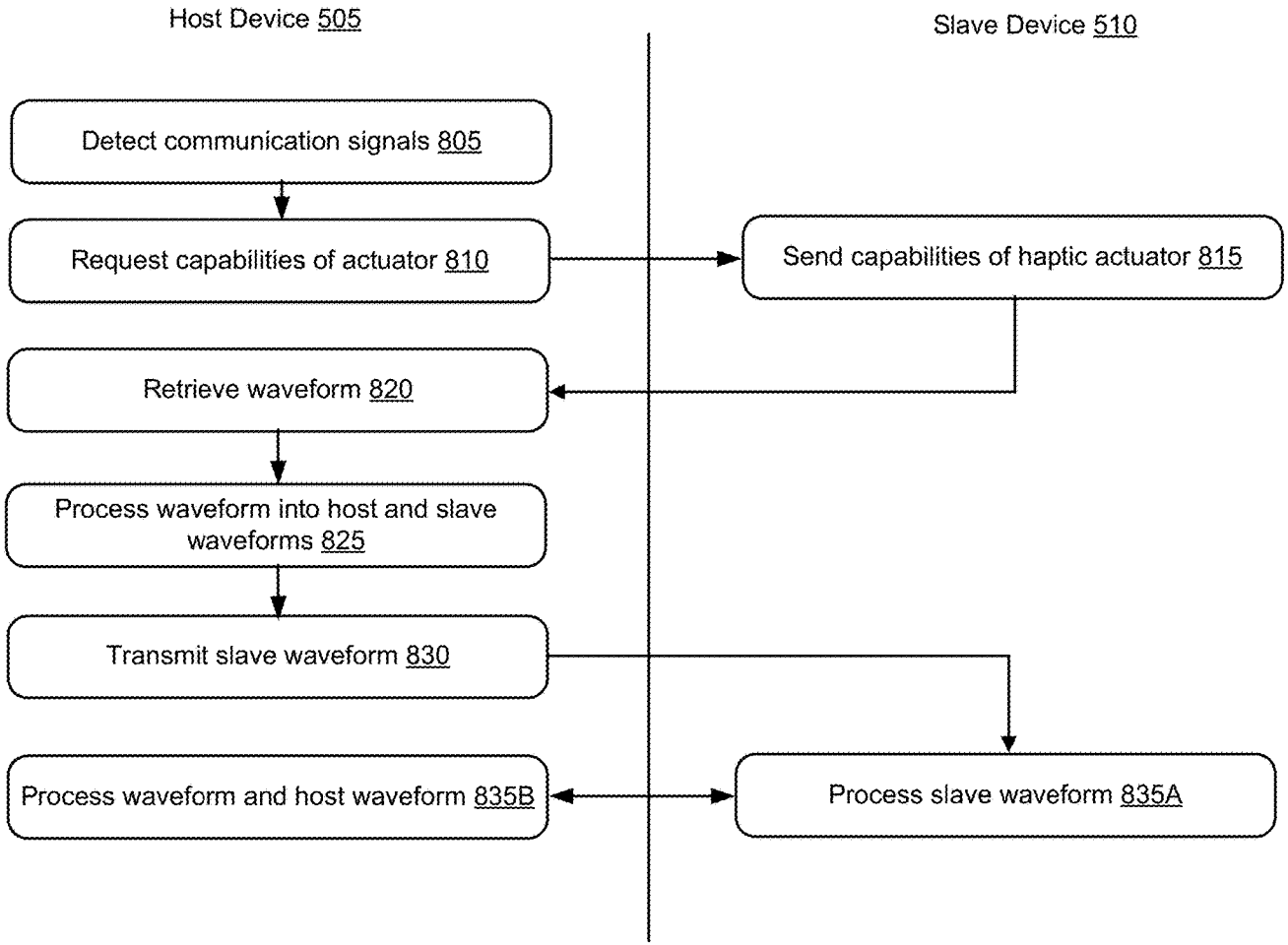
FIG. 8 shows a flow diagram depicting the functions of a host device and a slave device in accordance with some embodiments of the disclosure.

Reference is now made to FIG. 8, which depicts a flow diagram of the functions of host device 505 and a slave device 510 according to some embodiments of the present invention. At step 805, host device 505 detects communication signals. For example, host device 505 may detect a slave device 510 in communication with the host device 505. Host device 505 may also determine through its communication with slave device 510 that slave device 510 has an actuator. In some embodiments, the actuator is a haptic actuator.

At step 810, host device 505 requests the capabilities of the actuator from slave device 510. At step 815, slave device 510 sends the capabilities of the actuator to host device 505. The capabilities may include, for example, drive (DC or AC), drive voltage, frequency (e.g., a resonant frequency in the case of an LRA), amplitude, power consumption, response time, vibration strength, bandwidth and the like.

At step 820, host device 505 retrieves a waveform. The waveform may be retrieved, for example, from a database within host device 505, from slave device 510, from a remote server, from hardware coupled to host device 505, or from any other source. At step 825, host device 505 processes the waveform into a host waveform and a slave waveform. The host waveform and the slave waveform may be different types of waveforms than the retrieved waveform. For example, the host waveform and the slave waveform may be haptic waveforms, while the retrieved waveform is an audio waveform.

At step 830, host device 505 transmits the slave waveform to slave device 510. At step 835A, slave device 510 processes the slave waveform. Simultaneously, at step 835B, host device 505 processes the retrieved waveform and the host waveform. Host device 505 may synchronize processing of the waveform, the host waveform, and the slave waveform, such that they are processed simultaneously and are coordinated with one another. In some embodiments, processing of the waveform, the host waveform and the slave waveform includes outputting of the waveform, the host waveform and the slave waveform. For example, host device 505 may output the waveform and the host waveform, while slave device 510 outputs the slave waveform. In other embodiments, host device 505 may output the host waveform, while slave device 510 outputs the waveform and the slave waveform. In still other embodiments, host device 505 may output the host device, slave device 510 may output the slave waveform, and another device in communication with host device 505 may output the waveform.

Although shown and described herein primarily as converting an audio waveform to one or more haptic waveforms, it is contemplated that embodiments of the invention may be used to convert any waveform into another waveform, including between different types of waveforms and between different waveforms of the same type. For example, a haptic waveform may be converted into one or more audio waveforms in some embodiments. In some embodiments, an audio or haptic waveform may be converted into one or more visual waveforms, or vice versa. In some embodiments, a single waveform of one type (e.g., a haptic waveform) may be broken down into multiple waveforms of the same type (e.g., multiple haptic waveforms). Outputting (e.g., display or performance) of the waveforms by a plurality of devices may then be coordinated and synchronized by a host device as described further herein.

Embodiments of the invention may be implemented in a variety of environments. For example, embodiments of the invention may be used to help users with hearing impairments or hearing loss to enjoy music through touch sensations. Embodiments of the invention may also be used with augmented reality/virtual reality (i.e., immersive experiences), gaming, live and/or recorded experiences (e.g., musical performances, speaking engagements, rallies, songs, etc.), notifications (e.g., ringtones, text messages, driving notifications, etc.), and the like.

With respect to driving notifications, it is contemplated that embodiments of the invention may be used, for example, to coordinate haptic alerts of impending danger to a user, as determined by sensors integrated in the electronic device, host device and/or the slave devices. For example, an accelerometer in a host device may determine an extremely high rate of speed, and may coordinate and synchronize haptic alerts across the electronic device, host device and/or one or more slave devices. In another example, a microphone of the host device may detect an audio waveform corresponding to a nearby car slamming on its brakes, and may coordinate and synchronize haptic alerts across the electronic device, host device and/or one or more slave devices. The haptic alerts may be accompanied by synchronized audio and/or visual alerts in some embodiments. In some embodiments, if haptic waveforms are already being performed by the electronic device, host device and/or the slave devices at the time the notification is generated (e.g., to accompany a song on the radio), one or more of the previous haptic waveforms may be paused to draw attention to the haptic notification. In some embodiments, one or more of the previous haptic waveforms may be lessened in intensity such that the haptic notification is more intense. It is contemplated that driving notifications may be useful in both normal operation of vehicles and driverless operation of vehicles.

In addition, embodiments of the invention may be capable of transitioning between different environments. For example, if a user abruptly changes the song being performed on her MP3 player, the electronic device may coordinate a fading out of the previous haptic waveforms corresponding to the previous song and a fading in of the new haptic waveforms corresponding to the new song. Similarly, if a user is at a club and moves from a room playing a disco song to a room playing a pop song, the electronic device may fade out the haptic waveforms corresponding to the disco song as that audio signal becomes less strong, and fade in the haptic waveforms corresponding to the pop song as that audio signal becomes stronger. In some embodiments, the haptic waveforms corresponding to the previous environment may be blended with the haptic waveforms corresponding to the next environment while they are being transitioned.

It is contemplated that embodiments of the invention may also be implemented across devices of different users. In other words, a host device may coordinate and synchronize the performance of haptic waveforms across multiple slave devices associated with multiple different users. For example, a host device of a conductor may coordinate and synchronize the slave devices of orchestra members to act as haptic metronomes.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not taught to be exhaustive or to limit the embodiments to the precise forms disclosed. Many modifications and variations are possible in view of the above teachings.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

As noted, the computer-readable medium may include transient media, such as a wireless broadcast or wired network transmission, or storage media (that is, non-transitory storage media), such as a hard disk, flash drive, compact disc, digital video disc, Blu-ray disc, or other computer-readable media. The computer-readable medium may be understood to include one or more computer-readable media of various forms, in various examples.

In the foregoing description, aspects of the application are described with reference to specific embodiments thereof, but those skilled in the art will recognize that the invention is not limited thereto. Thus, while illustrative embodiments of the application have been described in detail herein, it is to be understood that the inventive concepts may be otherwise variously embodied and employed, and that the appended claims are intended to be construed to include such variations, except as limited by the prior art. Various features and aspects of the above-described invention may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as performing or being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the embodiments disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the methods described above. The computer-readable data storage medium may form part of a computer program product, which may include packaging materials. The computer-readable medium may comprise memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

The program code may be executed by a processor, which may include one or more processors, such as one or more digital signal processors (DSPs), general purpose microprocessors, an application specific integrated circuits (ASICs), field programmable logic arrays (FPGAs), or other equivalent integrated or discrete logic circuitry. Such a processor may be configured to perform any of the techniques described in this disclosure. A general purpose processor may be a microprocessor; but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Accordingly, the term "processor," as used herein may refer to any of the foregoing structure, any combination of the foregoing structure, or any other structure or apparatus suitable for implementation of the techniques described herein. In addition, in some aspects, the functionality described herein may be provided within dedicated software modules or hardware modules configured for encoding and decoding, or incorporated in a combined encoder-decoder (CODEC).

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

What is claimed is:

1. A method comprising:

receiving an audio waveform at an electronic device that includes one or more speakers and a haptic actuator;

generating an actuator control signal from the audio waveform, the actuator control signal comprising discrete haptic actuation taps corresponding to at least one of peak intensities and the onset of peak intensities of the audio waveform;

generating an audio output using the audio waveform at the one or more speakers;

synchronizing transmission of the actuator control signal to the haptic actuator with generation of the audio output at the one or more speakers; and actuating the haptic actuator with the actuator control signal while performing the audio output by the one or more speakers.

2. The method of claim 1, further comprising modifying the actuator control signal based on metadata associated with the audio waveform.

3. The method of claim 2, wherein the metadata associated with the audio waveform is selected from a group consisting of an artist, a genre and an album.

4. The method of claim 3, wherein generating the actuator control signal from the audio waveform comprises filtering the audio waveform using a bandpass filter.

5. The method of claim 1, wherein the electronic device further includes an input element, and wherein the method further comprises:

receiving a user input from the input element; and adjusting the actuator control signal based on the user input.

6. The method of claim 1, further comprising:

determining a contact location of the electronic device with a user of the electronic device; and modifying the actuator control signal based on the contact location.

7. The method of claim 1, further comprising:

identifying one or more different types of instruments contributing to audio waves making up the audio waveform; and modifying the actuator control signal based on the identified type of music.

8. The method of claim 1, wherein the electronic device includes a plurality of haptic actuators.

9. The method of claim 1, wherein generating the actuator control signal includes:

extracting a feature from the audio waveform selected from a group consisting of treble, bass, beat, tempo, time signature, rhythmic patterns, loudness range, change of loudness over time, accents, melodic properties, complexity of harmony, prominent pitch classes, melody, chorus, time, verse, number of instruments, types of instruments;

applying a haptic element to the actuator control signal based on the extracted feature.

10. An electronic device comprising:

one or more speakers;

a haptic actuator;

one or more processors; and a non-transitory computer readable medium including instructions that, when executed by the one or more processors, cause the one or more processors to perform operations including:

receiving an audio waveform, wherein the audio waveform is stereophonic;

generating an actuator control signal from the audio waveform, the actuator control signal comprising discrete haptic actuation taps corresponding to at least one of peak intensities and the onset of peak intensities of the audio waveform; and synchronizing transmission of the actuator control signal to the haptic actuator with transmission of the audio waveform to the one or more speakers; and actuating the haptic actuator with the actuator control signal while performing the audio waveform by the one or more speakers.

11. The electronic device of claim 10, wherein the haptic actuator is a linear actuator.

12. The electronic device of claim 10, wherein the electronic device further comprises an input element, and wherein the operations further include:

receiving a user input from the input element; and adjusting actuation of the haptic actuator based on the user input.

13. The electronic device of claim 10, wherein the operations further include:

determining a contact location of the electronic device with a user of the electronic device; and modifying the actuator control signal based on the contact location.

14. The electronic device of claim 10, wherein the operations further include:

identifying one or more different types of instruments contributing to audio waves making up the audio waveform; and modifying the actuator control signal based on the identified type of music.

15. The electronic device of claim 8, wherein generating the actuator control signal includes:

extracting a feature from the audio waveform; and applying a haptic element to the feature.

16. The electronic device of claim 10, wherein the electronic device includes a plurality of haptic actuators.

* * * * *